US006154978A

United States Patent [19]

Slutsky

[11] Patent Number: 6,154,978

[45] Date of Patent: Dec. 5, 2000

[54] APPARATUS AND METHOD FOR CONFIRMING INITIAL CONDITIONS OF CLOTHES DRYING EQUIPMENT PRIOR TO START OF DRYING CYCLE

[75] Inventor: Dennis Slutsky, Providence, R.I.

[73] Assignee: American Dryer Corporation, Fall River, Mass.

[21] Appl. No.: 09/305,198

[22] Filed: May 5, 1999

[51] Int. Cl.[7] ..... F26B 5/08

[52] U.S. Cl. ..... 34/321; 34/322; 34/454; 34/499; 34/527; 34/554; 34/572; 34/90; 34/595; 34/138; 34/202; 34/543

[58] Field of Search ..... 34/312, 313, 318, 34/364, 368, 486, 498, 499, 699; 392/350, 360, 379; 73/168

[56] References Cited

U.S. PATENT DOCUMENTS

| | | | |
|---|---|---|---|
| 3,558,110 | 1/1971 | Kushner | 34/45 |
| 3,636,638 | 1/1972 | Noyes | 34/45 |
| 3,650,673 | 3/1972 | Ehner | 8/137 |
| 3,668,784 | 6/1972 | Teague, Jr. et al. | 34/10 |
| 3,854,219 | 12/1974 | Staats | 34/1 |
| 4,006,534 | 2/1977 | Coffman | 34/54 |
| 4,067,383 | 1/1978 | Padden | 165/35 |
| 4,076,492 | 2/1978 | Alms et al. | 432/43 |
| 4,081,997 | 4/1978 | Losert | 73/168 |
| 4,083,118 | 4/1978 | Cotton | 34/53 |
| 4,086,053 | 4/1978 | Sommer, Jr. | 34/133 |
| 4,088,017 | 5/1978 | Olges | 73/168 |
| 4,231,166 | 11/1980 | McMillan | 34/48 |
| 4,236,320 | 12/1980 | Schwadike et al. | 34/19 |
| 4,483,082 | 11/1984 | Ellingson | 34/44 |
| 4,546,554 | 10/1985 | Bullock et al. | 34/48 |
| 4,689,896 | 9/1987 | Narang | 34/82 |
| 4,788,775 | 12/1988 | Ahmed | 34/48 |
| 4,795,871 | 1/1989 | Strattan et al. | 34/30 |
| 4,827,627 | 5/1989 | Cardoso | 34/44 |
| 5,062,219 | 11/1991 | Harris et al. | 34/133 |
| 5,127,169 | 7/1992 | Ellingson | 34/133 F |
| 5,161,314 | 11/1992 | Souza | 34/30 |
| 5,297,234 | 3/1994 | Harms et al. | 392/470 |
| 5,524,358 | 6/1996 | Matz | 34/275 |
| 5,555,645 | 9/1996 | Joslin | 34/499 |
| 5,560,124 | 10/1996 | Hart et al. | 34/493 |
| 5,649,372 | 7/1997 | Souza | 34/491 |
| 5,651,193 | 7/1997 | Rhodes et al. | 34/531 |
| 5,771,879 | 6/1998 | Saltzman | 126/299 R |
| 5,809,828 | 9/1998 | Gardell et al. | 73/865.9 |

FOREIGN PATENT DOCUMENTS

| | | | |
|---|---|---|---|
| 2258038 | 5/1974 | Germany | 392/350 |
| 08189687 | 7/1996 | Japan . | |
| WO 9626397 A1 | 8/1996 | WIPO . | |

OTHER PUBLICATIONS

"Air Flow and Temperature Sensor" by S. Ghose, Apr. 1971, IBM Technical Disclosure Bulletin, vol. 13, No. 11.

"Air Flow Sensor for Fans" by G.M. Barthel, Aug. 1979, IBM Technical Disclosure Bulletin, vol. 22, No. 3.

*Primary Examiner*—Denise L. Ferensic
*Assistant Examiner*—Andrea M. Joyce
*Attorney, Agent, or Firm*—Pollock, Vande Sande & Amernick, R.L.L.P.

[57] ABSTRACT

A method and apparatus for confirming the initial conditions of a clothes dryer prior to the start of the drying cycle is provided. The clothes dryer comprises a drying chamber with air inlet and outlet ports. A blower powered by a first motor is arranged in the outlet port to draw air into the drying chamber through the inlet port. A burner for heating the air before it enters the drying chamber is arranged in the inlet port. Also arranged at the inlet port is an air proving device for measuring the air flow through the drying chamber. A second motor is provided for the drive system which creates the tumbling action in the drying chamber. The air flow proving device must be enabled before the second motor is started.

13 Claims, 5 Drawing Sheets

APPARATUS AND METHOD FOR CONFIRMING INITIAL CONDITIONS OF CLOTHES DRYING EQUIPMENT PRIOR TO START OF DRYING CYCLE

BACKGROUND OF THE INVENTION

The present invention relates to an apparatus and method for drying clothes with heated air. Specifically, a controller is described which confirms the initial conditions of the dryer prior to the start of the drying cycle.

Conventional clothes dryers comprise a tumbling chamber into which a load of wet clothing is inserted. The chamber includes a tumbler which is rotated to effect tumbling of the clothes. A stream of hot air is forced through the tumbler which removes the moisture contained in the clothing to dry it. Conventional clothes dryers usually include a single motor which rotates the tumbling chamber as well as forces the air through the tumbler.

Reversing type clothes dryers have been in use for some time. A reversing type clothes dryer utilizes two separate motors. A first motor is attached to a fan or blower and is used for creating the air flow necessary in the drying process. A second motor is connected to the drive system which rotates the tumbler and enables the clothes tumbling action. Having separate motors for the fan and for the drive system allows the tumbling action of the clothes dryer to be reversed without affecting the fan and the air flow through the tumbling chamber.

In both the conventional and reversing type clothes dryers, damage may occur upon the failure of one of the dryer components. For example, if the blower or fan were to fail, it is possible that the burner would overheat causing damage to the burner system and potentially even a fire. In order to detect such unsafe situations resulting from insufficient air flow, a sail switch is utilized to measure the air flow in the combustion area as well as in the tumbler chamber. A sail switch is a mechanical switch that is switched on or off by the flow or non-flow of air. The sail switch is used to indicate that air is flowing to reduce the heat of combustion in the burner and thus prevent the destruction of heat exchanger components in the clothes dryer.

In a reversing machine, the presence of separate motors for the blower and the drive system make it possible to utilize the signal from the sail switch to provide additional safety features. The signal from the sail switch can be used to prevent any mechanical movement of the drive system when there is insufficient air flow in the drying chamber, thereby preventing personal injury in the event that the clothes dryer is used improperly.

SUMMARY OF THE INVENTION

The present invention provides a method and apparatus for controlling the start of the drying cycle in a clothes drying machine. The present invention prevents the mechanical movement of the drive system to present personal injury in the event that the equipment is used improperly. The invention also detects an insufficient air flow in the drying chamber to prevent the drying machine from being damaged.

The clothes dryer of the present invention comprises a tumbler motor connected to a tumbler and a fan motor connected to a fan. The tumbler motor is controlled by a microprocessor controller and enables a tumbler motor contactor. Means such as a sail switch are arranged to measure the air flow in the clothes dryer. The microprocessor controller receives a signal from the sail switch and provides a control signal for the tumbler motor contactor. The microprocessor controller is programmed to send an enabling signal to the tumbler motor contactor to start the tumbler motor only when a predetermined air flow in the clothes dryer is measured.

In a method according to a preferred embodiment of the present invention, when a start cycle button is pressed, the microprocessor controller sends a start signal to the blower motor. The blower motor generates an air flow in the tumbler. A sail switch measures the air flow and sends a signal to the microprocessor controller when sufficient air flow is present in the clothes dryer. The microprocessor controller detects whether the sail switch has been activated within a predetermined period of time after the blower motor has started. If the sail switch has been activated within the predetermined period of time, the microprocessor controller sends a start signal to start the tumbler motor. Otherwise, the drying cycle is interrupted and an error message is displayed.

In another embodiment of the present invention, after the tumbler motor is started, it is disabled by the microprocessor controller whenever the sail switch indicates that the air flow has fallen below a predetermined level.

In another embodiment of the present invention, when the dryer door is opened and a door switch has failed, the sail switch acts as a backup to the door switch and indicates that the air flow has dropped below the predetermined level. Thus, the microprocessor no longer receives a signal from the sail switch and it therefore disables the tumbler motor.

The present invention utilizes the presence of two separate motors and as a result provides an additional level of safety to prevent personal injury in the event that the clothes dryer is misused.

DETAILED DESCRIPTION OF THE INVENTION

The present invention provides an apparatus and method for confirming the initial conditions of a clothes dryer prior to the start of a drying cycle. The invention is preferably implemented in a clothes dryer of the reversing type. However, the present invention may be utilized in any dryer which has two or more motors. A reversing-type clothes dryer typically utilizes two electric motors. A first motor is attached to the blower or fan and is used for creating the air flow needed in the drying process. A second motor is connected to the drive system which rotates the tumbler and enables the clothes tumbling action. The present invention requires that the air flow in the clothes dryer be above a predetermined level before the drive system is enabled.

In a method according to the invention, the first motor is activated to generate the air flow in the dryer. An air flow monitoring device, for example a sail switch, is used to measure the air flow. The sail switch is designed to generate a signal when the air flow reaches a desired level. The sail switch communicates with a microprocessor controller which enables the drive system only when it receives the signal from the sail switch. If the air flow has not reached the desired level in a predetermined prior of time, an error message is displayed. The present invention can also detect when the air flow drops below the desired level after the drying cycle has started. In this case, the microprocessor no longer receives the signal from the sail switch and therefore disables the drive system.

Figure 1:
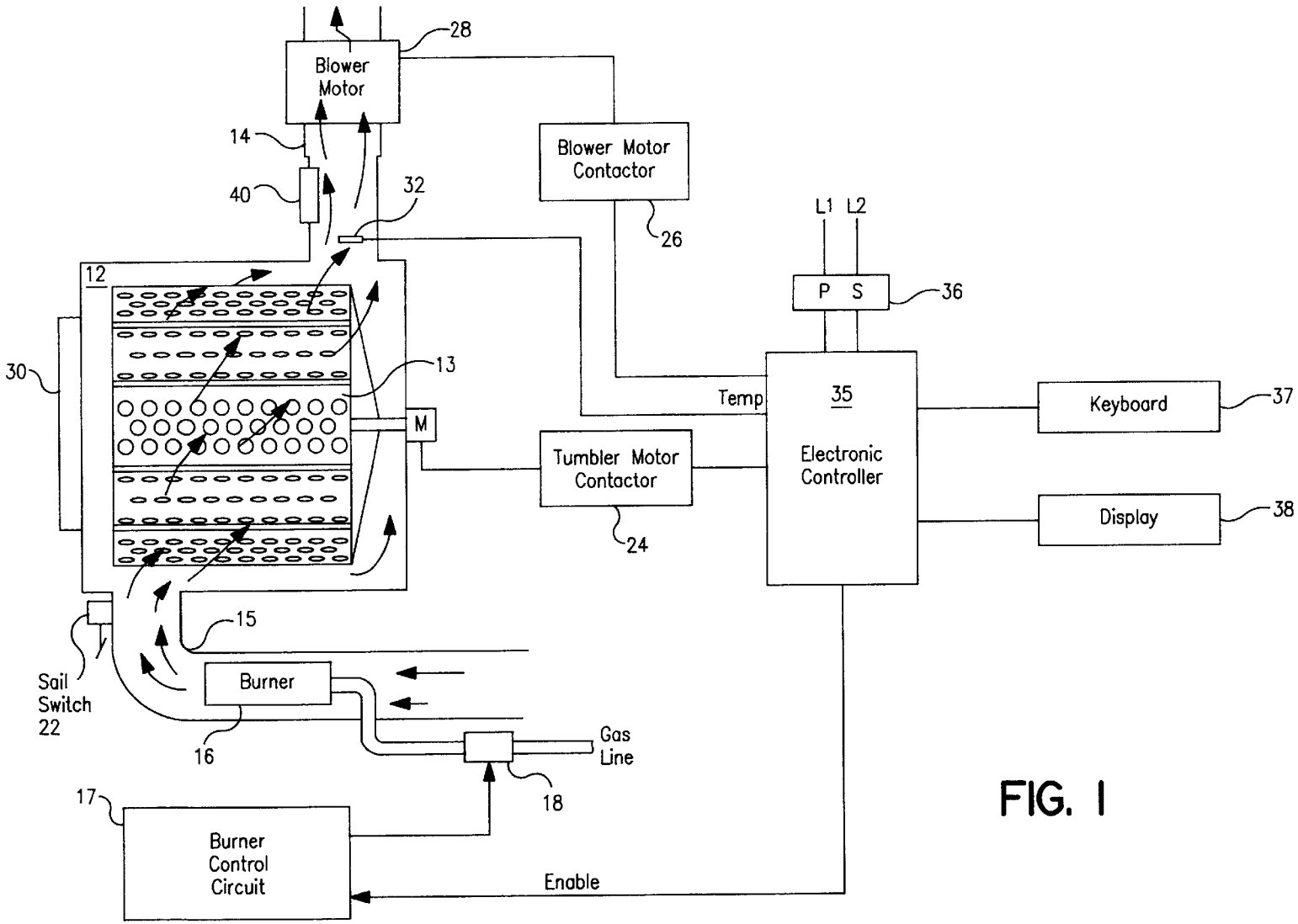
FIG. 1 illustrates a garment dryer having a controller for controlling the start of the drying cycle.

Referring to FIG. 1, there is shown an embodiment of an apparatus which may employ the start-up procedure of the present invention. The apparatus includes a drying chamber 12 housing a material tumbler 13. Around the surface of the drying chamber 12 is an air distributor which supplies air to the tumbling chamber heated by burner 16. A gas line valve 18 regulates the flow of gas to the burner 16, according to signals received from the burner control circuit 17. With moisture exists an exhaust port 14.

An electronic controller 35 will enable the blower motor contactor 26 at the initiation of a drying cycle. The blower motor 28 is arranged at the exhaust 14 and draws air into the drying chamber 12 through inlet 15. The blower motor contactor 26 is, of course, known in the art, and further description is unnecessary. A burner 16 is arranged in the air inlet 15 to heat the air provided to the drying chamber 12. The burner control circuit 17 receives an ENABLE and DISABLE signal from the controller 35. The flow of air from the inlet 15 through the drying chamber 12 and out through exhaust 14 is shown by arrows in FIG. 1.

A keyboard 37 and display 38 are used to interface the operator to the electronic controller 35. As will be apparent with respect to FIG. 2, the electronic controller 35 includes a programmable microprocessor, which can read keyboard comments from keyboard 37, as well as display various computed parameters and messages in display 38. Power is provided to the electronic controller 35 by a power supply (PS) 36.

A temperature sensor 32 is shown in the exhaust 14 which will give an accurate measurement of the drying temperature for the air in chamber 12. Preferably, the electronic controller 35, through the use of the microprocessor, will continuously read out values of temperature for the drying chamber 12, and based on the temperature readings, compare them with a known set point which has been pre-programmed in the electronic controller 35. The relationship between the sensed temperature from sensor 32 and set point versus burner control signal is shown more particularly in U.S. Pat. No. 4,827,627 which is incorporated herein by reference.

An air flow proving device, such as sail switch 22, is arranged at the air inlet 15. The sail switch is used to measure the air flow through the drying chamber 12. As described above, a sail switch is a mechanical switch that is switched on or off by the flow or non-flow of air, respectively. The sail switch is set so it is activated when a predetermined amount of air flow occurs through the drying chamber 12. Thus, when the desired air flow is achieved, the sail switch is activated and a signal is sent to electronic controller 35. The electronic controller 35 then enables the tumbler motor contactor 24 so that the tumbling action of the clothes may begin. The tumbler motor contactor 24 is known in the art and will not be described here further. The particular steps carried out by the electronic controller 35 during the start-up of the dryer are described more fully below.

Figure 2:
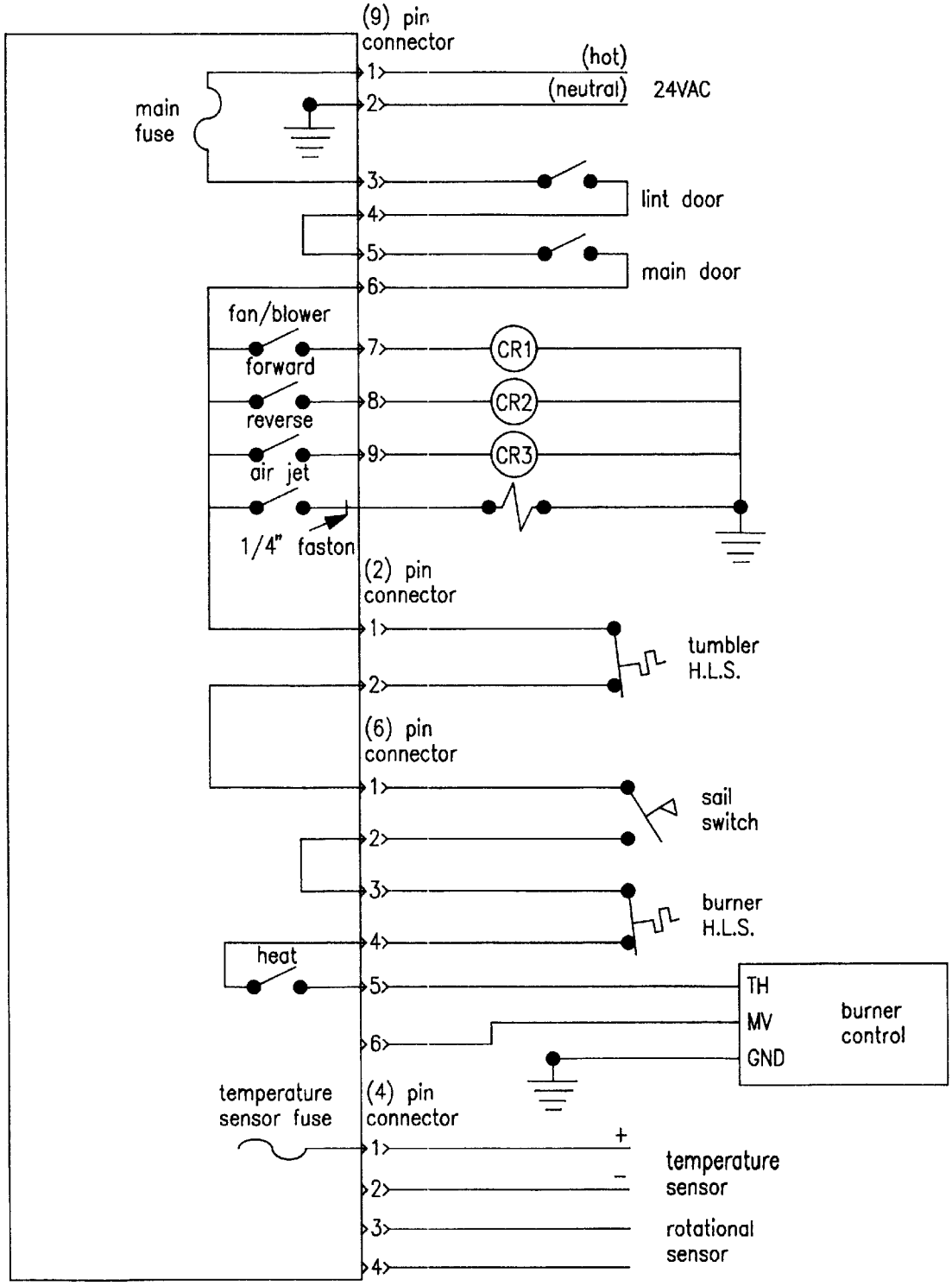
FIG. 2 is a schematic diagram illustrating the connection of the drying equipment to the controller.

A more detailed illustration of the connection of the dryer equipment to the electronic controller is shown in FIG. 2. The electronic controller may be constructed to incorporate each circuit in the dryer through the electronic controller for interpretation as shown in FIG. 2. Present FIG. 2 illustrates schematically a nine pin connector, a two pin connector, a six pin connector and a four pin connector, from top to bottom in the figure, used to connect the drying equipment to the electronic controller 35. Of particular relevance here is the six pin connector. As is shown in the figure, this is where the sail switch is connected to the electronic controller. Unless a sufficient air flow is present in the drying chamber, the sail switch will not be closed. Thus, the circuit will not be completed and the drying equipment will not be enabled. FIG. 2 also illustrates how the various other drying equipment is connected to the electronic controller 35. These connections are known and will not be described here further.

Figure 3:
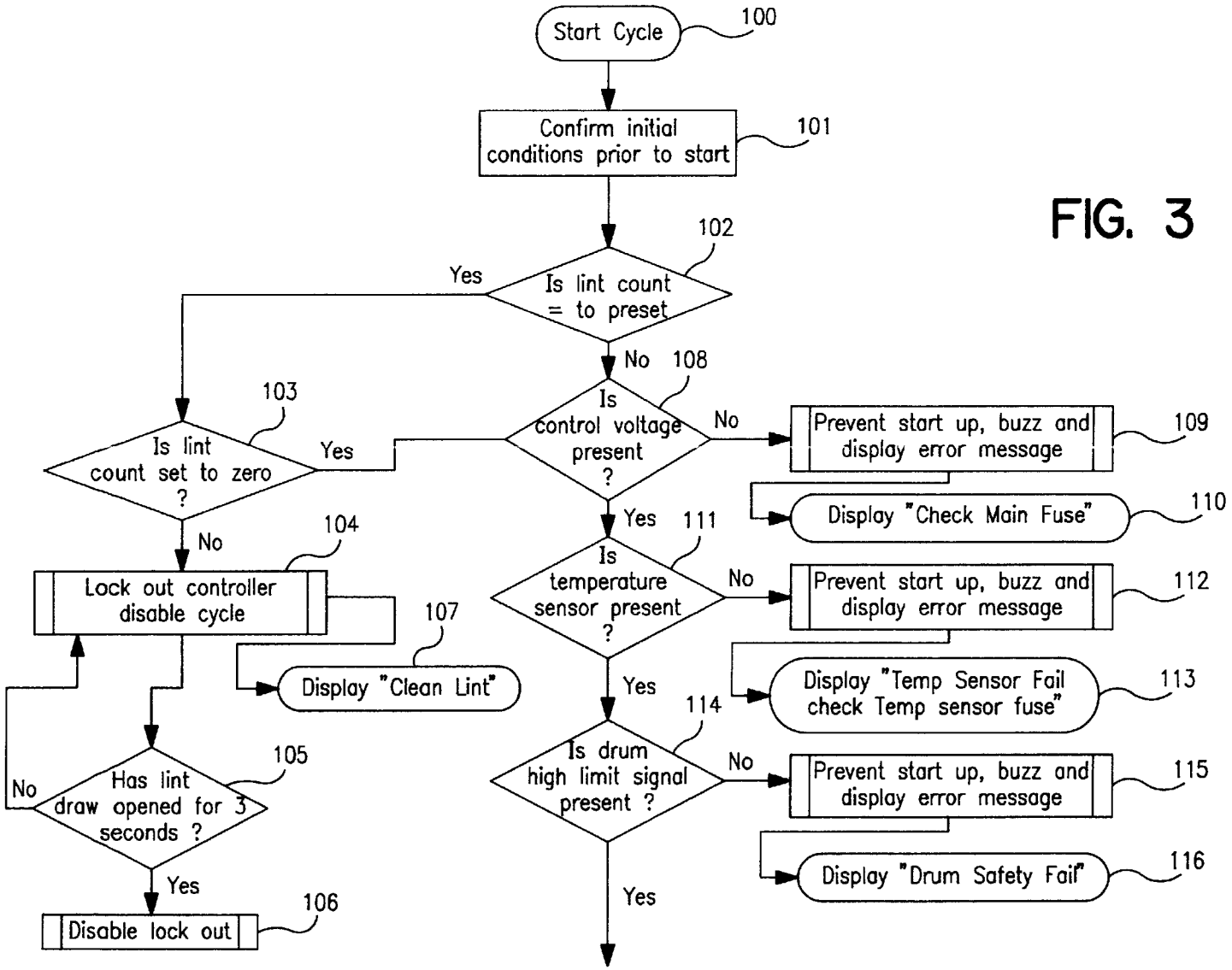
FIG. 3 is flow chart illustrating the steps carried out by the electronic controller when the dryer is operated.
Figure 4:
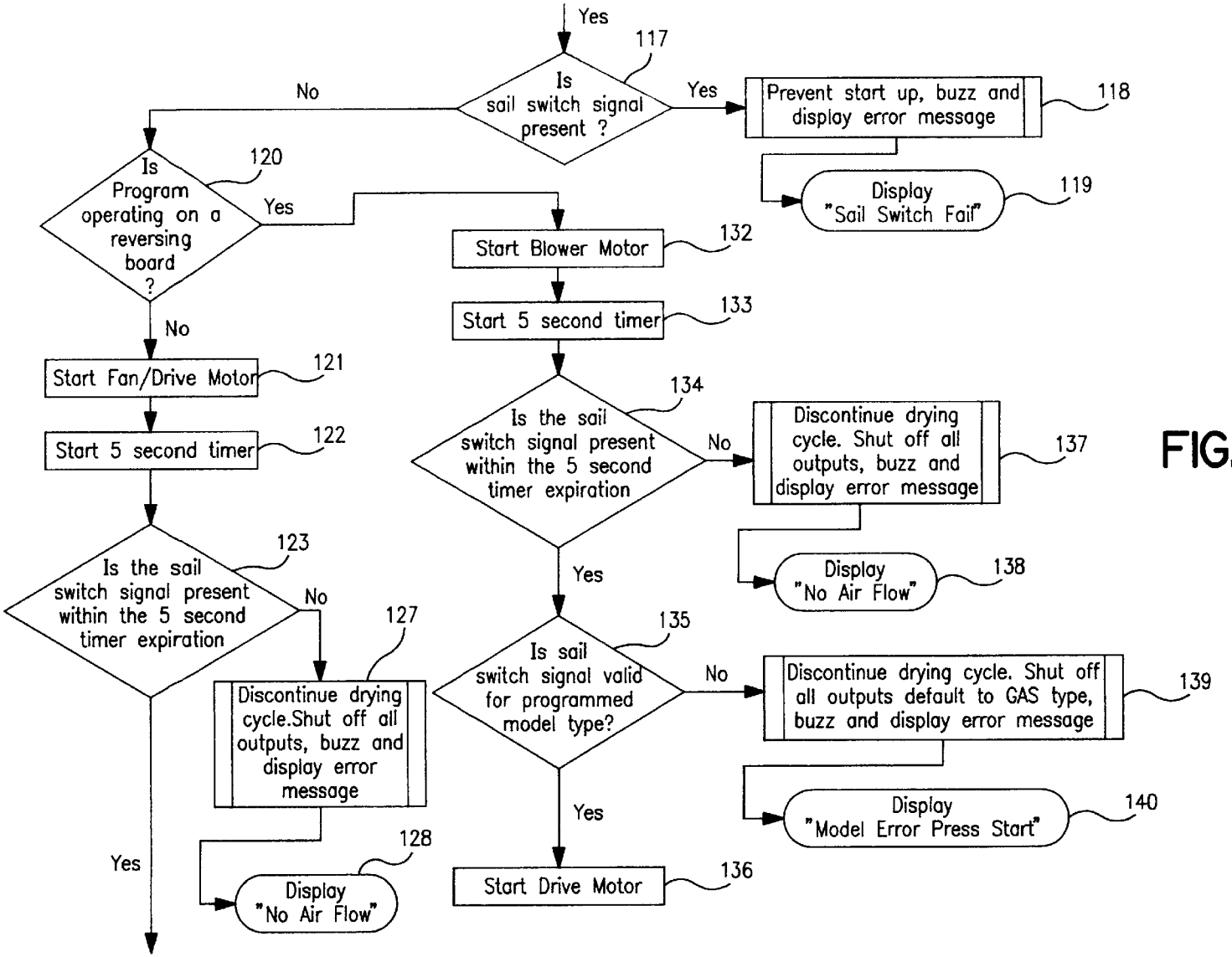
FIG. 4 is flow chart illustrating the steps carried out by the electronic controller when the dryer is operated.
Figure 5:
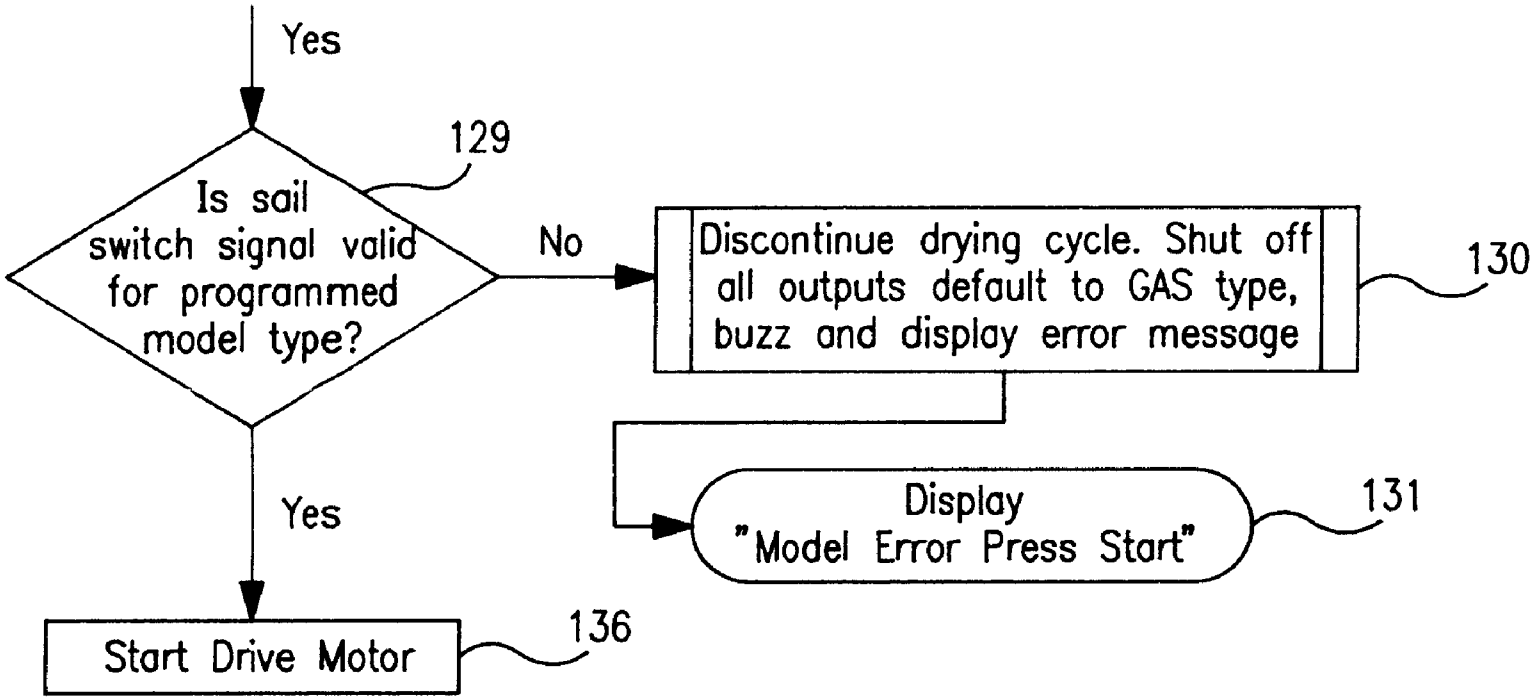
FIG. 5 is flow chart illustrating the steps carried out by the electronic controller when the dryer is operated.

Turning now to FIGS. 3–5, the programming steps executed by the electronic controller 35 during the start-up procedure in accordance with the present invention are more completely illustrated. The flow chart represented in FIGS. 3–5 illustrates a start-up procedure for the dryer of FIG. 1. Some known steps of the start-up procedure have been omitted to more clearly illustrate the concept of present invention.

The start-up program begins at step 100 when a start command is entered through the keyboard 37. Steps 101–116 are preliminary steps that occur before the start command is given to the blower motor. Steps 102–107 determine the number of cycles the machine has been through to determine if the lint trap should be cleaned. Steps 108–110 determine if there is sufficient voltage present to operate the machine. Steps 111–113 determine if the temperature sensor is present and steps 114–116 determine if the drum high limit signal is present. If any of the signals in steps 102, 108, 111 and 114 are not present, the start-up procedure is aborted, the machine buzzes and displays an error message along with a suggested remedy on the display. For example, steps 103–107 are the procedures the start-up program goes through to determine if the lint trap should be emptied. If the number of drying cycles the machine has executed is equal to a predetermined number, a message is shown on display 38 to clean the lint trap. Along these same lines, steps 110, 113 and 116 suggest the action to be taken if the electronic controller detects an error while confirming the initial conditions of the drying equipment.

Next, step 117 determines if the sail switch signal is present. As the blower motor has not been activated at this time, if the sail switch signal is present, an error has occurred. Consequently, steps 118, 119 discontinue the start-up procedure, the machine buzzes and displays an error message that the sail switch has failed. If the sail switch signal is not present, it is operating properly and the process continues to step 120. This step determines if the machine is of a reversing type. If the machine is not of a reversing type, only one motor is present and the program proceeds with steps 120–131. In step 121 the single motor for the fan and the drive system is started. The process then follows the normal start-up procedure for a convention clothes dryer as shown in the process flow diagram.

If the electronic controller detects that a reversing board is present, that is, the machine is of a reversing type, the start-up procedure for a reversing type machine is followed. Preferably, the procedure for a reversing machine is followed even if the machine will not be operated in reversing mode for this particular drying cycle. The program thus proceeds to step 132 and a start signal is sent to start the blower motor. This signal is preferably sent from electronic controller 35 to the blower contactor 26. Next, as shown in step 133, a timer is started. The timer is set for a period of time which it should take the blower to achieve the desired air flow in the drying chamber, for example about five seconds. This amount of time can vary depending on the blower and dryer type. Preferably, the timer is started at the same time the start signal is sent to the blower motor. When the air flow reaches the desired level, the sail switch is activated and generates a signal. The signal is sent to the electronic controller 35. However, if the blower is not able to create the desired amount of air flow in the dryer within the predetermined period of time, a problem has occurred with the blower motor, with the air flow inlet/outlet being clogged or another problem. Therefore, the electronic controller determines in step 134 if the sail switch has been activated within the predetermined period of time. If this has not occurred, the drying cycle is discontinued, all outputs from the electronic controller are shut off, the machine buzzes and displays an error message that there is no air flow, per steps 137, 138.

When the sail switch signal is received by the electronic controller within the predetermined period of time the process continues with step 135 and it is determined if the sail switch signal is valid for that particular dryer model. For example, when there is an error in the programming or the sail switch is set to be actuated at an incorrect level of air flow, the sail switch signal is not be valid for the programmed model type. In this case, the method proceeds to steps 139, 140 and discontinues the drying cycle and shuts off all outputs from the electronic controller. Preferably, the system would then default to GAS type, pause and display an error message that there is a model error and that the start button should be pressed. If the sail switch signal is valid, the drive motor is started in step 136. At this point, it has been determined that the blower motor has been turned on, is functioning properly and the desired level of air flows through the tumbler. Therefore, it is safe to start the drive motor. The start-up procedure can then continue in a known manner.

However, after the start-up procedure has been completed and the dryer has begun to operate, it is possible that the air flow through the dryer may fall below the desired level. This may occur, for example, if the door to the clothes dryer is open, among other reasons. Dryers typically include door switches which disable the dryer motors when the dryer door is opened. However, if the lint 40 or main 30 door to the clothes dryer is opened while the dryer is operating and the door switches fail or are bypassed, the continued rotation of the tumbler may cause serious injury to an operator who places his hands and/or arms inside the tumbling chamber. Therefore, the present invention is also designed to disable the tumbler motor when either of the door switches to the clothes dryer has failed. Thus, the reduction of air flow through the drying chamber caused by an open door is also detected using the sail switch.

The size of the inlet 15 and outlet 14 ports are chosen so that there is a predetermined amount of back pressure in the tumbling chamber during the drying cycle when the dryer is being used properly. Whenever the doors 30,40 to the clothes dryer open, some of the air being drawn by the blower 28 enters the drying chamber 12 through the open door 30 or through is drawn through lint door 40, rather than through inlet 15. The pressure in the tumbling chamber 12 changes, resulting in a reduced air flow through the inlet 15. The sail switch 22, preferably arranged in the inlet 15 near its opening to the drying chamber 12, is set so that when the air flow through the inlet drops below a predetermined value, the sail switch is disabled. The sail switch 22 no longer sends a signal to the electronic controller 35 that there is sufficient air flow through the tumbling chamber 12. In response, the electronic controller 35 disables the signal to the tumbler contactor 24, which disables the tumbler motor. Although many dryers contain separate sensors to determine when the lint or main door has been opened, the present invention provides an additional safety measure to protect the operator in case the dryer is used in an improper fashion. Further, if the dryer door 30 or lint door 40 is open when the start-up begins in step 100 and the door switch has failed or has been bypassed, the blower will not generate enough air flow to activate the sail switch. Thus, the tumbler motor will not start, reducing the risk of injury.

Accordingly, a method and apparatus for confirming the initial conditions of a clothes dryer prior to starting the drying cycle has been provided. The invention utilizes separate motors for the blower and the drive system in a clothes dryer to provide an additional level of safety. The present invention requires that the air flow proving device, for example a sail switch, be activated before the drive system is enabled. The present invention can also detect when a door switch to the clothes dryer has failed and disable the drive system. This prevents any mechanical movement of the drive system to avert personal injury in the event the drying equipment is used improperly.

While a preferred embodiment of the invention has been described above, since variations in the invention will be apparent to those skilled in the art, the invention should not be construed as limited to the specific embodiments described above. For example, the specific ordering of the steps of the start-up procedure may be rearranged as long as the start of the drive system remains dependent upon the presence of sufficient air flow through the dryer.

What is claimed is:

1. A method of starting a clothes dryer cycle comprising;

starting a blower motor to generate an air flow in a clothes dryer;

waiting a predetermined period of time;

detecting the air flow in said clothes dryer; and starting a tumbler motor only when sufficient air flow is present.

2. A method of starting a clothes dryer comprising:

starting a blower motor to generate an air flow in said clothes dryer;

generating a first start signal when the air flow in said dryer reaches a predetermined level within a predetermined period of time; and sending a second start signal to start a tumbler motor.

3. The method of claim 2 further comprising stopping said method of starting a clothes dryer when said first start signal is not received and displaying an error message.

4. In a clothes dryer comprising an air flow monitoring device arranged to measure air flow in said dryer, a method of starting a clothes dryer comprising:

sending a first start signal to a blower motor to generate an air flow in said clothes dryer;

sending an air flow signal from said air flow monitoring device to an electronic controller when sufficient air flow is present in said dryer;

detecting with said electronic controller whether said air flow monitoring device has been activated within a predetermined period of time after said first start signal has been sent to said blower motor; and sending a second start signal from said electronic controller to a tumbler motor when said air flow monitoring device has been activated within said predetermined period of time.

5. The method of claim 4 further comprising stopping said method of starting a clothes dryer when said air flow signal is not received within said predetermined period of time and displaying an error message.

6. The method of claim 4 further comprising;

before said sending a second start signal step, determining whether said air flow signal is valid for said dryer; and stopping said method of starting a clothes dryer when said air flow signal is not valid and displaying an error message.

7. A method for confirming an initial condition of a clothes dryer prior to starting a clothes dryer cycle comprising:

a) determining whether a reversing board is present, if so proceeding to step b);

b) starting a blower motor to generate an air flow in said clothes dryer;

c) generating a first signal when a predetermined level of air flow is present in said dryer;

d) detecting with an electronic controller whether said first signal is generated within a predetermined period of time after said blower motor starts;

e) stopping the procedure of steps in the method and displaying an error message if said first signal is not generated within said predetermined period of time after said blower motor starts, otherwise proceeding to step f); and f) sending a second start signal from said electronic controller to start a tumbler motor.

8. The method of claim 7 further comprising before step a), detecting whether said first signal is present, if so generating an error message, otherwise proceed to step a).

9. The method of claim 7 further comprising after step d) and before step f), determining whether said first signal is valid for said dryer, if not stopping the procedure of steps in the method and generating an error message, otherwise continuing with step f).

10. The method of claim 1 further comprising detecting when a clothes dryer door is opened by measuring a change in the air flow, within said clothes dryer, with an air flow monitoring device.

11. The method of claim 10 further comprising disabling said tumbler motor after said starting a blower motor step when the air flow becomes insufficient.

12. The method of claim 4 further comprising detecting when a clothes dryer door is opened by measuring a change in the air flow, within said dryer, with said air flow monitoring device.

13. The method of claim 12 further comprising disabling said tumbler motor after said sending a first start signal to a blower motor step when the air flow becomes insufficient.

* * * * *